US011291876B2

(12) United States Patent
Simpson et al.

(10) Patent No.: US 11,291,876 B2
(45) Date of Patent: Apr. 5, 2022

(54) FIRE SUPPRESSION AGENT COMPOSITION

(71) Applicant: Kidde Technologies, Inc., Wilson, NC (US)

(72) Inventors: Terry Simpson, Wake Forest, NC (US); Adam Chattaway, Old Windsor (GB)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 0 days.

(21) Appl. No.: 16/413,166

(22) Filed: May 15, 2019

(65) Prior Publication Data

US 2020/0330810 A1 Oct. 22, 2020

Related U.S. Application Data

(63) Continuation-in-part of application No. 16/388,975, filed on Apr. 19, 2019.

(51) Int. Cl.
*A62D 1/00* (2006.01)

(52) U.S. Cl.
CPC ..... *A62D 1/0092* (2013.01)

(58) Field of Classification Search
CPC ..... A62D 1/0092
See application file for complete search history.

(56) References Cited

U.S. PATENT DOCUMENTS

| | | | | |
|---|---|---|---|---|
| 2,692,649 | A | 10/1954 | McCreary | |
| 4,179,218 | A | 12/1979 | Erdmann et al. | |
| 4,911,129 | A | 3/1990 | Tomisawa | |
| 5,126,570 | A | 6/1992 | Boos | |
| 5,155,357 | A | 10/1992 | Hemond | |
| 5,281,816 | A | 1/1994 | Jacobson et al. | |
| 5,409,666 | A | 4/1995 | Nagel et al. | |
| 5,615,742 | A * | 4/1997 | Robin | A62D 1/005 169/45 |
| 5,695,688 | A | 12/1997 | Nimitz et al. | |
| 5,892,136 | A | 4/1999 | Nagasaki et al. | |
| 6,116,348 | A | 9/2000 | Drakin | |
| 6,181,426 | B1 | 1/2001 | Bender et al. | |
| 6,205,841 | B1 | 3/2001 | Shibamoto | |
| 6,217,788 | B1 | 4/2001 | Wucherer et al. | |
| 6,518,574 | B1 | 2/2003 | Castleman | |
| 6,526,764 | B1 * | 3/2003 | Singh | C09K 5/045 252/67 |
| 6,902,009 | B1 | 6/2005 | Meserve et al. | |
| 7,142,105 | B2 | 11/2006 | Chen | |
| 7,178,604 | B2 | 2/2007 | Meserve et al. | |
| 7,339,669 | B2 | 3/2008 | Matthiessen et al. | |
| 7,384,519 | B2 | 6/2008 | Cottrell et al. | |
| 8,004,684 | B2 | 8/2011 | Powell et al. | |
| 8,534,080 | B2 | 9/2013 | Perti | |
| 8,733,463 | B2 | 5/2014 | Meier | |
| 9,170,163 | B2 | 10/2015 | Susko | |
| 9,182,331 | B2 | 11/2015 | Hariram | |
| 9,207,172 | B2 | 12/2015 | Seebaluck et al. | |
| 9,233,264 | B2 | 1/2016 | Graham et al. | |
| 9,298,193 | B2 | 3/2016 | Susko | |
| 9,683,931 | B2 | 6/2017 | Andersen et al. | |
| 9,957,061 | B2 | 5/2018 | Stehman et al. | |
| 10,130,909 | B2 | 11/2018 | Low et al. | |
| 10,493,399 | B2 | 12/2019 | Low et al. | |
| 10,561,353 | B2 | 2/2020 | Lucisano et al. | |
| 2002/0011570 | A1 | 1/2002 | Castleman | |
| 2002/0055175 | A1 | 5/2002 | Casal et al. | |
| 2004/0000643 | A1 | 1/2004 | Karlsson | |
| 2005/0016741 | A1 | 1/2005 | Paulkovich | |
| 2005/0057751 | A1 | 3/2005 | Schenk et al. | |
| 2005/0115721 | A1 | 6/2005 | Blau et al. | |
| 2005/0145820 | A1 * | 7/2005 | Waldrop | A62D 1/00 252/3 |
| 2005/0178566 | A1 | 8/2005 | Meserve et al. | |
| 2006/0132796 | A1 | 6/2006 | Haran | |
| 2006/0232773 | A1 | 10/2006 | Barton et al. | |
| 2006/0243944 | A1 | 11/2006 | Minor et al. | |
| 2006/0273223 | A1 | 12/2006 | Haaland et al. | |
| 2008/0011159 | A1 | 1/2008 | Thomas et al. | |
| 2008/0032379 | A1 | 2/2008 | Haugland et al. | |
| 2008/0137516 | A1 | 6/2008 | Hamaguchi et al. | |
| 2008/0186489 | A1 | 8/2008 | Ahn | |
| 2009/0085224 | A1 | 4/2009 | Choi et al. | |
| 2010/0162738 | A1 | 7/2010 | Low et al. | |
| 2010/0257881 | A1 | 10/2010 | Perti | |

(Continued)

FOREIGN PATENT DOCUMENTS

| | | | |
|---|---|---|---|
| CN | 104483288 | A | 4/2015 |
| CN | 108195796 | A | 6/2018 |

(Continued)

OTHER PUBLICATIONS

Yoshida et al. English machine translation of JP08277389A (Year: 1996).*

3M™ Novec™ Brand, 3M™ Novec™ 1230 Fire Protection Fluid, Technical Data, Jan. 2020, 12 pages.

Non-Final Office Action for U.S. Appl. No. 16/388,975; Application Filing Date Apr. 19, 2019; dated Jan. 9, 2020; 24 pages.

Non-Final Office Action for U.S. Appl. No. 16/413,100; Application Filing Date May 15, 2019; dated Jan. 9, 2020, 19 pages.

Final Rejection for U.S. Appl. No. 16/388,967; Application Filing Date: Apr. 19, 2019; dated Dec. 9, 2020; 20 pages.

Non-Final Office Action for U.S. Appl. No. 16/388,959; Application Filing Date: Apr. 19, 2019; dated Jan. 25, 2021; 21 pages.

Extended European Search Report for European Application No. 19212814.8; Application Filing Date: Dec. 2, 2020; dated Sep. 29, 2020; 12 pages.

(Continued)

*Primary Examiner* — Peter F Godenschwager
(74) *Attorney, Agent, or Firm* — Cantor Colburn LLP

(57) ABSTRACT

Disclosed is a fire suppression agent composition including $CF_3I$ and an additional fire suppression agent selected from the group consisting of HFC-23, HFC-125, HFC-227ea, dodecafluoro-2-methylpentan-3-one (Novec 1230), and HCFO-1233zd(E), wherein the fire suppression agent composition passes the FAA aerosol can test.

12 Claims, No Drawings

(56) References Cited

U.S. PATENT DOCUMENTS

| | | | |
|---|---|---|---|
| 2011/0073794 | A1 | 3/2011 | Hagquist et al. |
| 2013/0240218 | A1 | 9/2013 | Mitchell et al. |
| 2014/0048737 | A1 | 2/2014 | Singh et al. |
| 2014/0216770 | A1 | 8/2014 | Gibson et al. |
| 2014/0231660 | A1 | 8/2014 | Fabre et al. |
| 2014/0233017 | A1 | 8/2014 | Hariram |
| 2014/0273240 | A1 | 9/2014 | Georgeson et al. |
| 2014/0340677 | A1 | 11/2014 | Sataka et al. |
| 2015/0041157 | A1 | 2/2015 | Mitchell et al. |
| 2015/0135745 | A1 | 5/2015 | Nappa et al. |
| 2015/0328489 | A1 | 11/2015 | Mondino |
| 2015/0376546 | A1 | 12/2015 | Diaz Gomez et al. |
| 2016/0096051 | A1 | 4/2016 | Baker et al. |
| 2016/0296780 | A1 | 10/2016 | Singh et al. |
| 2017/0072235 | A1 | 3/2017 | Ferguson et al. |
| 2018/0002586 | A1 | 1/2018 | Low et al. |
| 2018/0031425 | A1 | 2/2018 | Nishino et al. |
| 2018/0201817 | A1 | 7/2018 | Close et al. |
| 2018/0217054 | A1 | 8/2018 | Deguchi et al. |
| 2018/0287698 | A1 | 10/2018 | Oda |
| 2018/0318623 | A1 | 11/2018 | Richard et al. |
| 2019/0024126 | A1 | 1/2019 | Beckham et al. |
| 2019/0055442 | A1 | 2/2019 | Singh et al. |
| 2019/0083927 | A1 | 3/2019 | Low et al. |
| 2019/0085224 | A1 | 3/2019 | Sethi et al. |
| 2019/0161660 | A1 | 5/2019 | Yana Motta et al. |
| 2019/0161662 | A1 | 5/2019 | Sethi et al. |
| 2019/0161663 | A1 | 5/2019 | Sethi et al. |
| 2019/0168035 | A1 | 6/2019 | Conboy |
| 2019/0177589 | A1 | 6/2019 | Sethi et al. |
| 2020/0205897 | A1 | 7/2020 | Liu et al. |
| 2020/0208882 | A1 | 7/2020 | Ota et al. |
| 2020/0330808 | A1 | 10/2020 | Simpson et al. |
| 2020/0330809 | A1 | 10/2020 | Simpson |
| 2020/0332192 | A1 | 10/2020 | Simpson et al. |
| 2020/0333233 | A1 | 10/2020 | Simpson et al. |

FOREIGN PATENT DOCUMENTS

| | | | |
|---|---|---|---|
| GB | 2439209 | A | 12/2007 |
| JP | 60139262 | S | 7/1985 |
| JP | 08277389 | A * | 10/1996 |
| JP | 2018153463 | A | 10/2018 |
| WO | 9743012 | A1 | 11/1997 |
| WO | 2010001430 | A2 | 1/2010 |

OTHER PUBLICATIONS

Final Office Action for U.S. Appl. No. 16/388,959; Application Filing Date: Apr. 19, 2019; dated Sep. 9, 2020; 22 pages.
Non-Final Office Action for U.S. Appl. No. 16/388,975; Application Filing Date: Apr. 19, 2019; dated Sep. 18, 2020; 31 pages.
Non-Final Office Action for U.S. Appl. No. 16/413,100; Application Filing Date: May 15, 2019; dated Sep. 17, 2020; 29 pages.
European Search Report for European Application No. 19212840.3; Application Filing Date: Dec. 2, 2019; dated Jul. 14, 2020, 9 pages.
European Search Report for European Application No. 19211917.0; Application Filing Date: Nov. 27, 2019; dated Jun. 23, 2020; 7 pages.
European Search Report for European Application No. 19212780.1; Date of Filing: Dec. 2, 2019; dated Jun. 24, 2020; 6 pages.
European Search Report for European Application No. 19212793.4; Application Filing Date: Dec. 2, 2019; dated Jun. 23, 2020, 7 pages.
European Search Report for European Application No. 19212814.8; Application Filing Date: Dec. 2, 2019; dated Jun. 23, 2020, 14 pages.
Final Office Action for U.S. Appl. No. 16/388,975; Application Filing Date Apr. 19, 2019; dated Apr. 16, 2020; 16 pages.
Final Office Action for U.S. Appl. No. 16/413,100; Application Filing Date May 15, 2019; dated Apr. 16, 2020, 17 pages.
Non-Final Office Action for U.S. Appl. No. 16/388,959; Application Filing Date Apr. 19, 2019; dated May 26, 2020; 33 pages.
Non-Final Office Action for U.S. Appl. No. 16/388,967; Application Filing Date: Apr. 19, 2019; dated Aug. 4, 2020, 42 pages.
Reinhardt, John W.; "Behavior of Bromotrifluoropropene and Pentafluoroethane When Subjected to a Simulated Areosol Can Explosion", DOT/FAA/AR-TN04/4, May 2004, 26 pages.
Final Rejection for U.S. Appl. No. 16/388,975; Application Filing Date: Apr. 19, 2019; dated Mar. 26, 2021; 35 pages.
Final Rejection for U.S. Appl. No. 16/413,100; Application Filing Date: May 15, 2019; dated Mar. 29, 2021; 33 pages.
Final Office Action for U.S. Appl. No. 16/388,959; Application Filing Date: Apr. 19, 2019; dated Jun. 30, 2021; 24 pages.
Notice of Allowance for U.S. Appl. No. 16/388,959; Application Filing Date: Apr. 19, 2019; dated Sep. 20; 9 pages.

* cited by examiner

FIRE SUPPRESSION AGENT COMPOSITION

CROSS REFERENCE TO RELATED APPLICATIONS

This applications is a continuation in part of U.S. patent application Ser. No. 16/388,975 filed on Apr. 19, 2019 which is incorporated by reference herein in its entirety.

BACKGROUND

Exemplary embodiments of the present disclosure pertain to the art of fire suppression agents.

Halon 1301 has frequently been employed as a fire suppression agent but there is currently a desire to replace Halon 1301 with more environmentally friendly fire suppression agents or blends of agents. $CF_3I$ has been suggested as an alternative but faces obstacles. Solutions are needed for environmentally friendly fire suppression agents which incorporate $CF_3I$.

BRIEF DESCRIPTION

Disclosed is a fire suppression agent composition including $CF_3I$ and an additional fire suppression agent selected from the group consisting of HFC-23, HFC-125, HFC-227ea, dodecafluoro-2-methylpentan-3-one (Novec 1230), and HCFO-1233zd(E), wherein the fire suppression agent composition passes the FAA aerosol can test.

In addition to one or more of the features described above, or as an alternative to any of the foregoing embodiments, the fire suppression agent composition has a lower human toxicity than $CF_3I$.

In addition to one or more of the features described above, or as an alternative to any of the foregoing embodiments, $CF_3I$ is present in an amount of 30 to 70 weight percent (wt %), based on the total weight of the fire suppression composition.

In addition to one or more of the features described above, or as an alternative to any of the foregoing embodiments, the additional fire suppression agent is present in an amount of 30 to 70 wt %, based on the total weight of the fire suppression composition.

In addition to one or more of the features described above, or as an alternative to any of the foregoing embodiments, the molar ratio of $CF_3I$ to the additional fire suppression agent is 0.4 to 1.5.

In addition to one or more of the features described above, or as an alternative to any of the foregoing embodiments, the additional fire suppression agent has a boiling point lower than $CF_3I$. The difference between the boiling points is greater than or equal to 10° C. The difference between the boiling points is greater than or equal to 25° C.

DETAILED DESCRIPTION

A detailed description of one or more embodiments of the disclosed composition are presented herein by way of exemplification and not limitation.

The FAA aerosol can test (FAA-ACT) simulates a fire in an aircraft cargo bay container that heats an aerosol can, causing it to burst and fueling an explosion. In the FAA-ACT, a heated container at about 16 bar, releases its contents (270 grams (g) ethanol, 90 g propane, and 90 g water), as a two-phase impulsive spray via a fast-acting valve. A continuous direct current arc across electrodes (6.4 mm gap, shielded from the high-velocity spray) located about 1 meter downstream of the valve ignites the mixture. The fireball expands into the chamber atmosphere of premixed ambient air, water vapor and suppressant. The temperature and pressure in the chamber increase over a time of about 1 second, and in the absence of suppressant, the peak pressure rise is about 2 bar. During each test, instruments record the pressure, temperature, visual images, and concentrations of agent and oxygen. Unconfined tests without suppressant create a 3.4 m diameter fire ball.

Currently there is no efficient, non-toxic replacement for Halon 1301 which has a low ozone depletion potential (ODP). Described herein is a fire suppression agent composition comprising $CF_3I$ and an additional fire suppression agent selected from the group consisting of HFC-23, HFC-125, HFC-227ea, dodecafluoro-2-methylpentan-3-one (Novec 1230), and HCFO-1233zd(E), wherein the fire suppression agent composition passes the FAA aerosol can test.

$CF_3I$ and blends including $CF_3I$ are an environmentally attractive alternative to fire extinguishing agents like Halon 1301 because $CF_3I$ has a lower ozone depletion potential than Halon 1301. The lower ozone depletion potential is due to the lower stability of the molecule. However, $CF_3I$ does have an unsuitable toxicity profile. The blends described herein address these issues by providing a fire suppression agent composition that can pass the FAA-ACT, has a more acceptable toxicity profile than $CF_3I$ and has a lower ozone depletion potential than Halon 1301.

The fire suppression agent composition includes $CF_3I$ in combination with an additional fire suppression agent selected from the group consisting of HFC-23, HFC-125, HFC-227ea, dodecafluoro-2-methylpentan-3-one (Novec 1230), and HCFO-1233zd(E). The $CF_3I$ may be present in an amount greater than or equal to 30 wt %, or, greater than or equal to 35 wt %, or, greater than or equal to 40 wt %, based on the total weight of the fire suppression agent composition. The $CF_3I$ may be present in an amount less than or equal to 70 wt %, based on the total weight of the fire suppression agent composition.

The additional fire suppression agent may be present in an amount greater than or equal to 30 wt %, or, greater than or equal to 35 wt %, or, greater than or equal to 40 wt %, based on the total weight of the fire suppression agent composition. The additional fire suppression agent may be present in an amount less than or equal to 70 wt %, based on the total weight of the fire suppression agent composition.

Exemplary combinations are shown in the following table.

| | |
|---|---|
| $CF_3I$ 45 wt % | HFC-125 55 wt % |
| $CF_3I$ 44 wt % | Novec 1230 56 wt % |
| $CF_3I$ 66 wt % | HCFO-1233zd(e) 34 wt % |

In some embodiments the molar ratio of $CF_3I$ to the additional fire suppression agent is 0.4 to 1.5, or, 0.5 to 1.3, or 1.0 to 1.2.

In some embodiments the additional fire suppression agent has a boiling point less than the boiling point of $CF_3I$. The difference between the boiling points can be greater than or equal to 10° C., or, greater than or equal to 30° C.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A fire suppression agent composition comprising $CF_3I$ and an additional fire suppression agent selected from the group consisting of HFC-23, dodecafluoro-2-methylpentan-3-one, and HCFO-1233zd(E), wherein the fire suppression agent composition passes the FAA aerosol can test and $CF_3I$ is present in an amount of 40 to 70 wt %, based on the total weight of the fire suppression agent composition and the additional fire suppression agent is present in an amount greater than or equal to 30 wt %, based on the total weight of the fire suppression agent composition;

wherein the molar ratio of $CF_3I$ to the additional fire suppression agent is 1.0 to 1.2.

2. The composition of claim 1, wherein the additional fire suppression agent has a boiling point lower than $CF_3I$.

3. The composition of claim 2, wherein the difference between the boiling points is greater than or equal to 10° C.

4. The composition of claim 2, wherein the difference between the boiling points is greater than or equal to 25° C.

5. The composition of claim 1, wherein the additional fire suppression agent is selected from the group consisting of dodecafluoro-2-methylpentan-3-one and HCFO-1233zd(E).

6. The composition of claim 1, wherein the additional fire suppression agent is selected from the group consisting of dodecafluoro-2-methylpentan-3-one.

7. A fire suppression agent composition consisting of $CF_3I$ and an additional fire suppression agent selected from the group consisting of HFC-23, dodecafluoro-2-methylpentan-3-one, and HCFO-1233zd(E), wherein the fire suppression agent composition passes the FAA aerosol can test and $CF_3I$ is present in an amount of 40 to 70 wt %, based on the total weight of the fire suppression agent composition;

wherein the molar ratio of $CF_3I$ to the additional fire suppression agent is 1.0 to 1.2.

8. The fire suppression agent composition of claim 7, wherein the additional fire suppression agent is present in an amount greater than or equal to 30 wt %, based on the total weight of the first suppression agent composition.

9. The composition of claim 7, wherein the additional fire suppression agent has a boiling point lower than $CF_3I$.

10. The composition of claim 9, wherein the difference between the boiling points is greater than or equal to 10° C.

11. The composition of claim 7, wherein the additional fire suppression agent is selected from the group consisting of dodecafluoro-2-methylpentan-3-one and HCFO-1233zd (E).

12. The composition of claim 7, wherein the additional fire suppression agent is selected from the group consisting of dodecafluoro-2-methylpentan-3-one.

* * * * *